US008851185B2

(12) United States Patent
Duong

(10) Patent No.: US 8,851,185 B2
(45) Date of Patent: Oct. 7, 2014

(54) DUAL METAL SEAL SYSTEM

(75) Inventor: Khanh Anh Duong, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 13/359,291

(22) Filed: Jan. 26, 2012

(65) Prior Publication Data

US 2012/0118585 A1 May 17, 2012

Related U.S. Application Data

(63) Continuation of application No. 12/912,487, filed on Oct. 26, 2010.

(51) Int. Cl.
*E21B 33/03* (2006.01)
*E21B 33/00* (2006.01)

(52) U.S. Cl.
CPC ..... *E21B 33/03* (2013.01); *E21B 2033/005* (2013.01)
USPC ..... 166/368

(58) Field of Classification Search
USPC ..... 166/387, 338, 340, 348, 360, 368, 243; 277/328, 337–339
See application file for complete search history.

(56) References Cited

U.S. PATENT DOCUMENTS

| | | | | |
|---|---|---|---|---|
| 1,872,665 | A | 8/1932 | Brownell | |
| 2,628,112 | A | 2/1953 | Hebard | |
| 3,284,086 | A | 11/1966 | Primrose et al. | |
| 4,521,040 | A | 6/1985 | Slyker et al. | |
| 4,595,053 | A * | 6/1986 | Watkins et al. | 166/209 |
| 4,702,481 | A | 10/1987 | Brammer | |
| 4,714,111 | A | 12/1987 | Brammer | |
| 4,751,965 | A | 6/1988 | Cassity | |
| 4,949,787 | A | 8/1990 | Brammer et al. | |
| 5,230,498 | A | 7/1993 | Wood et al. | |
| 5,456,314 | A * | 10/1995 | Boehm et al. | 166/208 |
| 5,801,429 | A | 9/1998 | Konishi et al. | |
| 5,904,354 | A | 5/1999 | Collins | |
| 6,082,402 | A | 7/2000 | Galle | |
| 6,318,729 | B1 | 11/2001 | Pitts, Jr. et al. | |
| 6,367,558 | B1 | 4/2002 | Borak, Jr. | |
| 6,637,750 | B2 | 10/2003 | Quoiani | |

(Continued)

FOREIGN PATENT DOCUMENTS

| | | | |
|---|---|---|---|
| GB | 2485047 | A | 5/2012 |
| GB | 2489593 | A | 10/2012 |
| GB | 2495394 | A | 4/2013 |

OTHER PUBLICATIONS

Search Report from corresponding GB Application No. 1301107.7, dated May 1, 2013.

*Primary Examiner* — David Andrews
*Assistant Examiner* — Ronald Runyan
(74) *Attorney, Agent, or Firm* — Bracewell & Giuliani LLP

(57) ABSTRACT

A wellhead seal assembly has a primary seal and a secondary seal, each seal forming a metal-to-metal seal between inner and outer wellhead members. A primary metal seal ring has inner and outer walls separated by a slot. A secondary metal seal is located below the seal ring and has a bottom portion that contacts an upward facing shoulder of a hanger. A primary energizing exerts downward force on the primary seal, causing a secondary energizing ring, located below the primary energizing ring, to energize the secondary seal. Once the secondary seal is energized, thus stopping downward movement of the (primary seal and secondary energizing ring, the primary energizing ring energizes the primary seal.

11 Claims, 3 Drawing Sheets

(56) References Cited

U.S. PATENT DOCUMENTS

| | | | |
|---|---|---|---|
| 6,763,891 | B2 | 7/2004 | Humphrey |
| 7,240,735 | B2 | 7/2007 | Crozier |
| 7,614,447 | B2 | 11/2009 | Jennings |
| 7,618,045 | B2 | 11/2009 | Heinfried et al. |
| 7,762,319 | B2 | 7/2010 | Nelson |
| 7,861,789 | B2 | 1/2011 | Nelson |
| 8,096,560 | B2 | 1/2012 | Pallini, Jr. |
| 8,146,670 | B2 | 4/2012 | Ellis |
| 8,167,312 | B2 | 5/2012 | Adamek |
| 8,186,426 | B2 | 5/2012 | Nelson |
| 2010/0116489 | A1 | 5/2010 | Nelson |
| 2010/0194049 | A1 | 8/2010 | Kocurek |
| 2011/0174506 | A1 | 7/2011 | Duong |
| 2012/0098203 | A1 | 4/2012 | Duong |

* cited by examiner

DUAL METAL SEAL SYSTEM

RELATED APPLICATION DATA

This application is a continuation in part of U.S. patent application Ser. No. 12/917,487, filed on Oct. 26, 2010, which is incorporated by reference in its entirety.

FIELD OF THE INVENTION

This invention relates in general to wellhead assemblies and in particular to an all-metal secondary that is energized by the primary seal assembly, before the primary seal assembly is energized.

BACKGROUND OF THE INVENTION

In hydrocarbon production wells, it is often necessary to form a seal between two wellbore members. For example, a wellhead housing can be located at the upper end of the well. The wellhead housing is a large tubular member having an axial bore extending through it. Casing will extend into the well and will be cemented in place. A casing hanger, which is on the upper end of the casing, will land within the wellhead housing. It is necessary to form a seal between the casing hanger and the wellhead housing. The exterior of the casing hanger is spaced from the bore of the wellhead housing by an annular clearance which provides a pocket for receiving an annulus seal.

There are many types of annulus seals, including rubber, rubber combined with metal, and metal-to-metal (all-metal). One metal-to-metal seal in use has a U-shape, having inner and outer walls or legs separated from each other by an annular clearance. An energizing ring, which can have smooth inner and outer diameters, can be pressed into this clearance to force the legs apart to seal in engagement with the bore and with the exterior of the casing hanger.

All-metal seals can be useful because they can withstand higher pressure and temperature than elastomeric seals. The metallic seals require an energizing ring to move axially to energize the seal. The requirement of using an energizing ring makes it difficult to have an all-metal secondary seal to seal the same annular clearance that the primary seal is sealing.

SUMMARY OF THE INVENTION

In one embodiment, a seal assembly having an all-metal secondary seal is disclosed. The seal assembly can have a secondary energizing ring that can energize the secondary seal, in the same annular clearance but spaced apart from the primary seal. The secondary energizing ring can be a component of the (primary seal assembly. The secondary energizing ring can energize the secondary seal before the primary seal is energized. In embodiments where the secondary seal is an H-seal, the secondary energizing ring can wedge the H-seal apart into, for example, the hanger and the housing, thus creating seals. The design allows for spring forces (potential energy) to be built into the seal itself. The design can also allow for pressure energization.

DETAILED DESCRIPTION OF THE INVENTION

Figure 1:
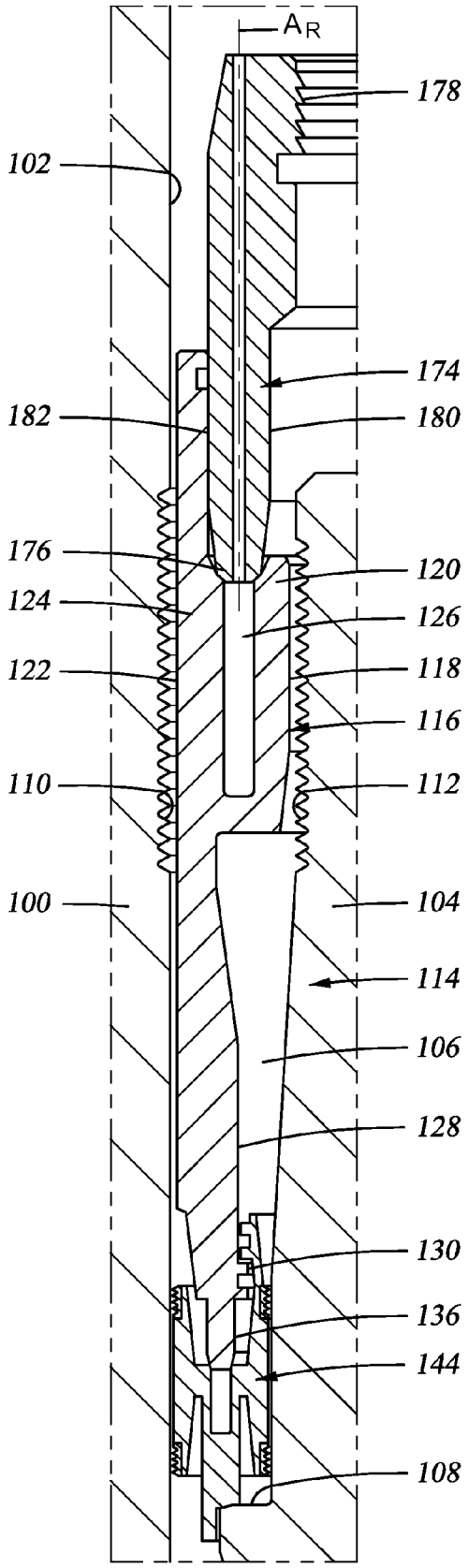
FIG. 1 is a sectional view of an embodiment of a seal assembly having an all-metal secondary seal.

Referring to FIG. 1, an embodiment of the invention shows a portion of a wellhead assembly that includes a high pressure wellhead housing 100. In this example, housing 100 is located at an upper end of a well and serves as an outer wellhead member of the wellhead assembly. Housing 100 has a bore 102 located therein. In this example, an inner wellhead member is a casing hanger 104, which is shown partially in FIG. 1 within bore 102. Alternately, wellhead housing 100 could be a different wellbore member, such as a tubing spool or a Christmas tree. Casing hanger 104 could be a different wellbore member, such as tubing hanger, plug, safety valve, or other device. Casing hanger 104 has an exterior annular recess radially spaced inward from bore 102 to define a seal pocket 106. An upward facing shoulder 108 can define the lower end of seal pocket 102. Wickers 110 can be located on a portion of the wellhead bore 102 and wickers 112 can be located on a portion of the cylindrical wall of seal pocket 106, in this example, the profiles of each set of wickers 110, 112 are shown as continuous profiles on the bore 102 and seal pocket 106. However, the wickers 110, 112 may be configured in other arrangements. Some embodiments can have a smooth sealing surface (not shown) rather than wickers.

Continuing to refer to FIG. 1, a metal-to-metal seal assembly 114 is lowered between housing 100 and casing hanger 104 and located in seal pocket 106. Seal assembly 114 can include a seal ring 116 formed of a metal such as steel. Seal ring 116 can have an inner wall surface 118 that can be a part of inner seal leg 120 for sealing against the cylindrical wall of casing hanger 104. Seal ring 116 can have an outer wall surface 122, that can be part of outer seal leg 124, that seals against wellhead housing bore 102. Each wall surface 118, 122 can be cylindrical and smooth and can engage the wickers 110, 112 when deformed against the bore 102 of the housing 100 and seal pocket 106 of the casing hanger 104. Wickers 110, 112 can enhance the grip to aid in the prevention of axial movement of the seal assembly once set.

In the example FIG. 1, seal ring 116 is uni-directional, having an upper section only; however, a seal ring that is bi-directional can be used. The upper section of seal ring 116 can have a slot 126. The inner and outer surfaces forming slot 126 can be generally cylindrical surfaces, that when viewed in an axial cross-section are generally parallel and each follow a straight line.

Figure 2:
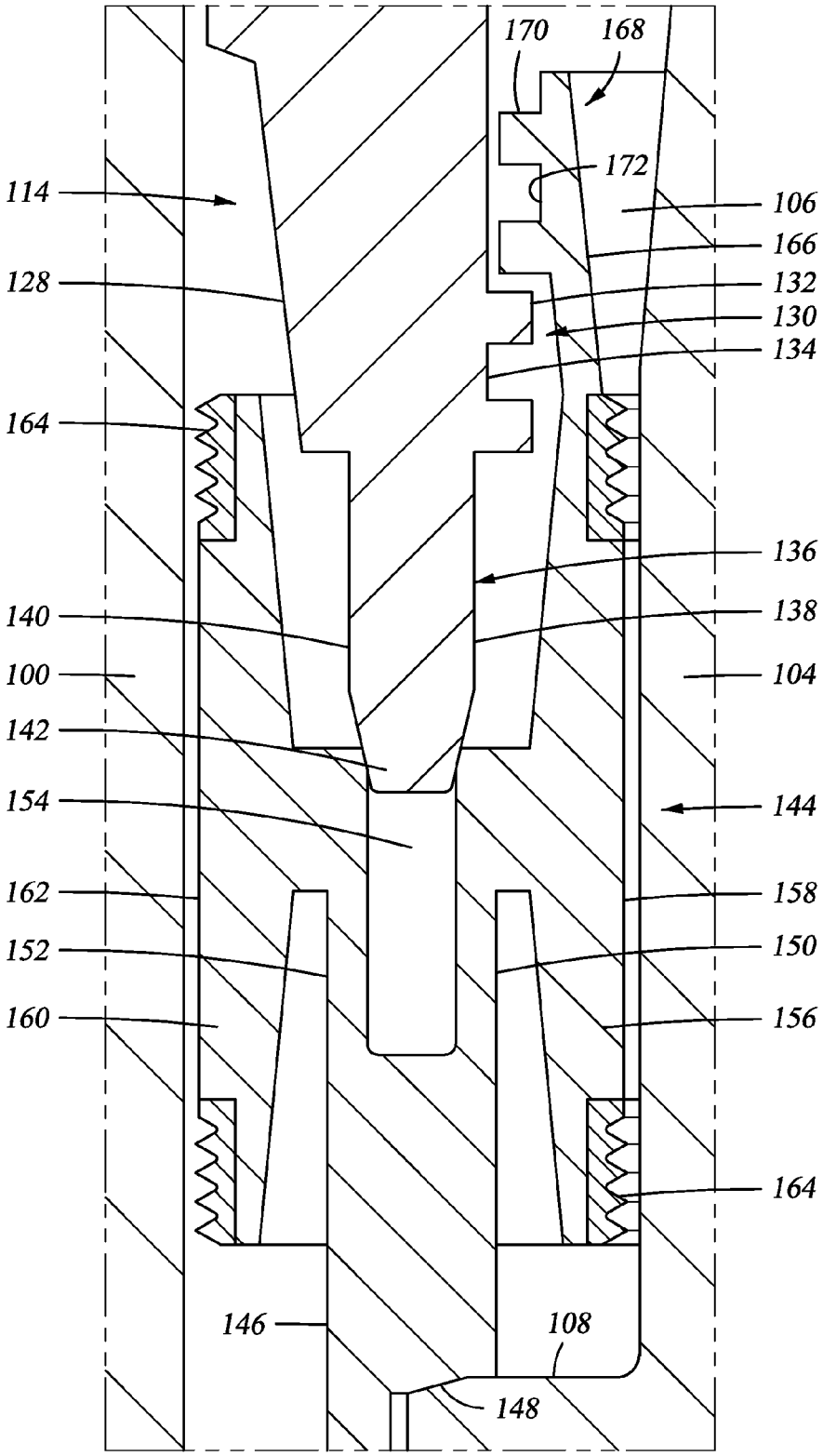
FIG. 2 is an enlarged sectional view of the secondary seal energizing ring and all-metal secondary seal of FIG. 1.

A seal assembly extension 128 can be a cylindrical body that extends below seal ring 116. Seal assembly extension 128 can be integrally formed with seal ring 116, or can otherwise be connected to it. Alternatively, extension 128 can be support members, or legs, (not shown) that extend axially downward from seal ring 116. As best shown in FIG. 2, a coupling, such as seal assembly lower threads 130, can be located on an inner or outer diameter of extension 128. In the embodiment shown in FIG. 1, lower threads 130 are on an inner diameter of extension 128. In one embodiment, lands 132 protrude from the surface of the inner or outer diameter of extension 128 and grooves 134 are not recessed into the surface.

Still referring to FIG. 2, seal assembly energizing ring 136 can extend downward from the lower end of extension 128. Seal assembly energizing ring 136 can be an annular ring having an inner surface 138 and an outer surface 140. Inner surface 138 and outer surface 140 can be straight walls that are parallel to each other and to the axis of seal assembly 114, or they can have a taper such that they are nearer each other near nose 142 and gradually spaced further apart as they approach the lower end of extension 128. Nose 142 of energizing ring 136 can be the lowermost surface of seal assembly energizing ring 136 and of seal assembly 114, and can have a rounded or tapered profile.

Referring to FIGS. 1 and 2, secondary seal assembly 144 can be a seal located below seal assembly 114. In some embodiments, secondary seal assembly 144 is an all-metal seal made of for example, steel. In the embodiment shown in FIGS. 1-2, seal assembly 144 is an H-shaped seal, although other types of seals can be used. Seal assembly 144 can be an annular seal that can be set, or energized, by seal assembly energizing ring 136.

Referring to FIG. 2, in one embodiment, seal assembly 144 can include base ring 146, which can be an annular ring having in inner and outer diameter and a support surface 148. Support surface 148 can be perpendicular to the axis of seal assembly 144, such that it faces downward in the axial direction when seal assembly 144 is in a vertical orientation. When inserted into seal pocket 106, support surface 148 can land on and be supported by shoulder 108. The other end of seal assembly 144 can have inner support ring 150 and outer support ring 152 extending in an axial direction to define slot 154 located therebetween. Slot 154 can be open on the upward facing side when seal assembly 144 is in a vertical orientation. The radial width of slot 154 can be less than the radial width of seal energizing ring 136, such that when seal energizing ring 136 is forced into slot 154, it urges inner support ring 150 and outer support ring 152 radially apart from each other.

Inner seal leg 156 can be an annular sealing member connected to inner support ring 150. Inner seal leg 156 can have a sealing surface 158 on an inner diameter for sealing against a wellbore member such as casing hanger 104. Similarly, outer seal leg 160 can be an annular sealing member connected to outer support ring 152, and can have a sealing surface 162 on an outer diameter for sealing against a wellbore member wellhead housing 100. Either or both of seal legs 156, 160 can have wickers 164 on their respective sealing surfaces 158, 162. Wickets 164 can be annular ridges with grooves therebetween, wherein the ridges can be pressed against or into the surface with which it is to form a seal. In one embodiment, support rings 150, 152 can connect to an axial midpoint of seal legs 156, 160. The ends of seal legs 156, 160, such as near wickers 164, can develop a spring or preload force as a result of radial force from support rings 150, 152.

A support member, such as threaded support 166, can be connected to secondary seal assembly 144 for coupling it to seal assembly 114 or, more specifically, to seal assembly extension 128. In one embodiment, threaded support 166 can extend from inner seal leg 156 upward toward seal assembly 114. Threaded support 166 can have threads 168 extending therefrom. Lands 170 can extend outward from a surface of threaded support 166, such that grooves 172 are not recessed into the surface of threaded support 166. Threads 168 can be sized to interface with seal assembly lower threads 130. Secondary seal assembly 144 can be rotated onto seal assembly lower threads 130, and then be rotated until threads 168 advance axially upward, past seal assembly lower threads 130. Once threads 168 are clear of lower threads 130, secondary seal assembly 144 can slide axially upward and downward along seal assembly 114 so that energizing ring 136 can engage slot 154, except that lower threads 130 and threads 168 prevent secondary seal assembly 144 from disengaging seal assembly 114 unless and until it is rotated through the threads. In one embodiment, threads 168 can threadingly engage and rotate completely through seal assembly lower threads 130 before seal assembly energizing ring 136 enters slot 154.

Referring back to FIG. 1, energizing ring 174 can be used to first apply downward force on seal assembly 114, without energizing seal assembly 114, to cause seal assembly 114 to transmit force to seal assembly energizing ring 136 and, thus, energize secondary seal assembly 144. After energizing secondary seal assembly 144, continued downward force on energizing ring 174 can cause it to energize seal assembly 114. In one embodiment, as described in more detail below, the profile of nose 176 of energizing ring 174 and the chamfer at the mouth of slot 126 can be used to selectively apply downward or energizing force on seal assembly 114. In another embodiment, shear pins (not shown) can be used to selectively apply downward or energizing force.

Annular energizing ring 174 engages slot 126 on the upper side of seal assembly 114. As shown, energizing ring 174 has an axis $A_R$ that is substantially parallel with an axis (not shown) of the wellhead assembly. Energizing ring 174 is forced downward into slot 126 by a running tool (not shown) connected to grooves 178 on the inner diameter of upper energizing ring 174 during setting. Alternatively, seal assembly 114 and energizing ring 174 may be part of a string that is lowered into bore 102, the weight of which forces energizing ring 174 into slot 126. If retrieval is required, the grooves 178 can be engaged by a retrieving tool (not shown) to pull energizing ring 174 from set position. Energizing ring 174 can be formed of metal, such as steel. The mating surfaces of energizing ring 174 and outer seal leg 124 may be formed at a locking taper.

Figure 3:
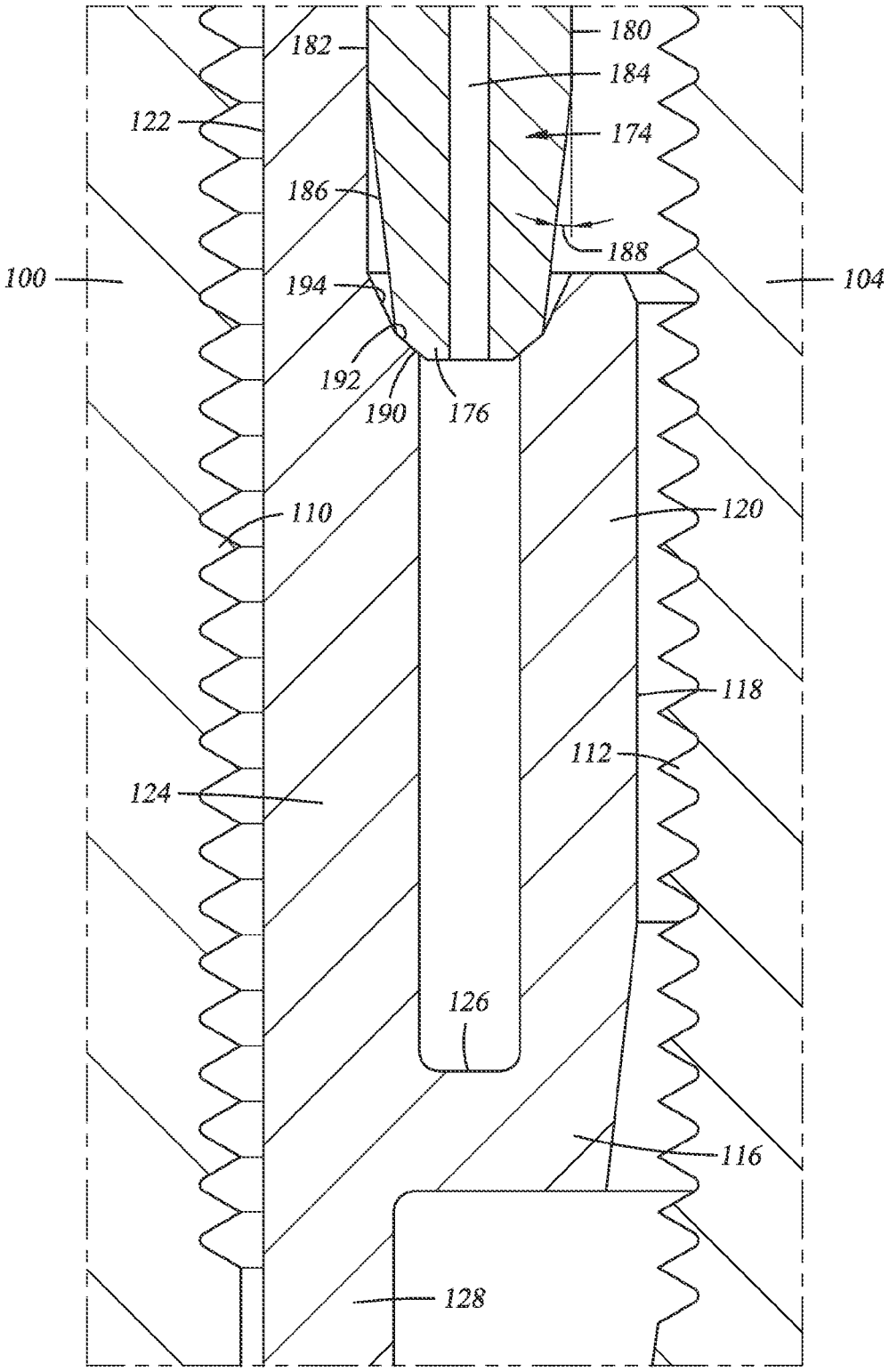
FIG. 3 is an enlarged sectional view of the primary seal and energizing ring

Referring to FIGS. 1 and 3, energizing ring 174 can have a nose 176 or engaging portion that engages slot 126. Energizing ring 174 can have an inner surface 180 and an outer surface 182 for engaging the opposite inner sidewalls of slot 126 in seal ring 116. Inner and outer surfaces 180, 182 may be straight surfaces as shown, or optimally curved surfaces.

Referring to FIG. 3, an enlarged sectional view of the nose 176 of the energizing ring 180 is shown in the unset positions. The nose 176 may have a vent 184 to prevent hydraulic locking and may have a first tapered surface or portion 186 that tapers downwards at an angle 188 and have a second tapered surface or portion 190. The inner and outer legs 120, 124 of the seal ring 116 have tapered, upward facing shoulders 192, 194 at their upper ends and proximate the opening of the slot 126. The shoulders 192, 194 form a corresponding surface on which the second tapered surface 190 of the nose 176 rests when in the unset position. The taper of the first and second tapered surfaces 186, 190 form a compound angle that may be varied to achieve a delay in the entry of the energizing ring 180 into the slot 126 of the seal ring 116. For example, if less taper is provided to the second tapered surface 190 such that it is flatter, more force will be required to be applied to the energizing ring 174 to force the nose 176 into the slot 126 and consequently the secondary seal 144 (FIG. 2) will be energized with greater force than if second tapered surface 190 had more taper (meaning less downward force would be required to energize seal assembly 114). The second tapered surface 190 may vary in taper from 0 degrees (flat), which provides the most resistance, up to 90 degrees. The first tapered surface 186 may have a taper angle 188 that varies between 0 and 30 degrees. Various combinations of angles for both tapered surfaces 186, 190 may be used depending on the applications and may be affected by the material and construction of secondary seal assembly 144 (FIG. 2).

By delaying the entry of the energizing ring nose 176 into the slot 126 as force is applied to the energizing ring 174

(FIGS. 1 and 3), setting of the legs 120, 124 of the seal ring 116 is delayed and the downward force is transmitted to seal assembly energizing ring 136. Referring now to FIG. 2, energizing ring 136, in turn, exerts downward force on secondary seal assembly 144, urging it toward shoulder 108. When secondary seal assembly can no longer move downward relative to casing hanger 104, continued downward force on seal ring 116 (FIG. 1) causes seal assembly energizing ring 136 to enter slot 154. Because the radial thickness of seal assembly energizing ring 136 can be greater than the initial radial dimension of slot 154, when energizing ring 136 is inserted into slot 154, secondary seal assembly 144 is deformed against wellhead housing 100 and casing hanger 104. In the embodiment shown in FIGS. 1 and 2, inner surface 138 urges inner support ring 150 toward casing hanger 104, causing inner seal leg 156 to sealingly engage casing hanger 104. Similarly, outer surface 140 urges outer support ring toward wellhead housing 100, causing outer seal leg 160 to sealingly engage wellhead housing 100. Energizing ring 136 can move downward until it bottoms out in slot 154. Because threads 168 have been rotated past seal assembly lower threads 130, the threads allow downward movement of seal assembly energizing ring 136 relative to secondary seal assembly 144.

After secondary seal 144 is energized, the surface force between the second tapered surface 190 of the nose 176 and the upward facing shoulder 192 may be overcome by the force applied to energizing ring 174 (FIG. 3) to thereby initiate the entry of the nose 176 into the slot 126. In an example embodiment, the first tapered surface 186 of the nose 176 is significantly more tapered than that of the second tapered surface 190 to facilitate entry of the nose 176 into the slot 126 and thereby deform the legs 120, 124 of the seal ring 116 against the wickers 110, 112 of the housing 100 and hanger 104. Once the legs 120, 124 are set, seal assembly 114 cannot move axially downward, and thus secondary seal 144 cannot be further energized. Control of the amount of axial force applied to seal energizing ring 136 can also be tuned by varying the surface area between the contacting surface of the second tapered surface 190 and the upward facing shoulder 192. A larger surface area at this contact surface may aid the delay of entry of the nose 176 into the slot 126.

In an example of operation of the embodiment shown in FIGS. 1-3, a running tool or string (not shown) is attached to seal assembly 114 (FIG. 1) and lowered into the seal pocket 106. Seal assembly 114 may be pre-assembled with energizing ring 174, seal ring 116, and secondary seal 144, all connected as shown in FIG. 1. The running tool or string (not shown) can be attached to grooves 178 on energizing ring 174. The outer wall 122 of outer seal leg 124 will be closely spaced to wickers 110 on the wellhead bore 102. The inner wall 118 of inner seal leg 120 will be closely spaced to the wickers 112 on the cylindrical wall of seal pocket 106. By pushing energizing ring 174 downward (such as by the running tool) with sufficient force such that the second tapered surface 190 at nose 176 of the energizing ring 174 transmit force via the upward facing tapered shoulders 192, down through the seal ring 116 to secondary seal 144, to thereby energize secondary seal 144. After secondary seal 144 is energized, continued force is applied to energizing ring 174 to overcome the surface forces between the second tapered surfaces 190 of the nose 176 and the tapered shoulders 192 of the seal ring 116, to insert the nose 176 in the slot 126. Urging the nose 176 into the slot 126 is facilitated by the first tapered surfaces 186 of the nose 176 because they have significantly more taper and thus less resistance than the second tapered surfaces 190. Further, engagement of nose 176 with slot 126 causes the inner and outer seal legs 120, 122 to move radially apart from each other. The inner wall 118 of inner seal leg 120 will embed into wickers 112 in sealing engagement while the outer wall 122 of outer seal leg 124 will embed into wickers 110 in sealing engagement. Once the inner and outer seal legs 120, 124 seal against the wickers 110, 112 of the wellhead members 100, 104, secondary seal 144 cannot be further energized.

If the seal formed by the wickers 110, 112 and the inner and outer seal legs 120, 124 is compromised due to excessive thermal growth cycles or higher operating pressures, then secondary seal 144 can maintain seal integrity between the outer and inner wellhead members 100, 104.

In the event that seal assembly 114 is to be removed from bore 102, a running tool is connected to threads 178 on upper energizing ring 174. As one of ordinary skill will appreciate, an upward axial force is applied to upper energizing ring 174, causing it to withdraw from slot 126. However, a retaining member (not shown) will keep energizing ring 174 connected to seal ring 116, preventing the two from fully separating. With energizing ring 174 withdrawn from slot 126, there is less radial pressure between seal legs 120, 124 and adjacent sealing surfaces such as wickets 110, 112. Continued upward movement of energizing ring 174 can cause seal assembly 114 to move axially upward, thus withdrawing seal assembly energizing ring 136 from slot 154. With energizing ring 136 clear of slot 154, radial pressure between seal legs 156 and 160 is reduced so that upward force on secondary seal assembly 144 can withdraw secondary seal assembly 144.

As best shown in FIG. 2, as seal assembly 114 continues to move upward, the uppermost thread of threads 130, specifically, the top land 132 on seal assembly extension 128, can contact the lowermost thread of threads 168, specifically, the bottom land 170, on threaded support 166 of secondary seal assembly 144. In some embodiments, the upper and lower threads function as shoulders and transmit axial force without threadingly engaging one another. Some embodiments can use alternative engagement devices to transmit axial force between seal assembly 114 and secondary seal assembly 144. The upward force, thus, causes secondary seal assembly 144 to be withdrawn from seal pocket 106.

In an additional embodiment (not shown), the wellhead housing 100 could be a tubing spool or a Christmas tree. Furthermore, the casing hanger 104 could instead be a lock-down hanger, tubing hanger, plug, safety valve or other device.

While the invention has been shown in only one of its forms, it should be apparent to those skilled in the art that it is not so limited but is susceptible to various changes without departing from the scope of the invention. For example, the seal could be configured for withstanding pressure in two directions, if desired, having two energizing rings. In addition, each energizing ring could be flexible, rather than solid.

What is claimed is:

1. A wellhead sealing assembly, comprising:

a first seal member, the first seal member having inner and outer annular walls to define a slot therebetween, the first seal member having first seal threads protruding from a first seal member surface;

a first energizing ring concentric with the first seal member and moveable between an upper and a lower position, the first energizing ring slidingly engaging the inner and outer walls to occupy the slot while moving from the upper to the lower position;

a second seal member concentric with and located below the first seal member, the second seal member having second seal threads protruding from a second seal member surface, the first seal threads and the second seal threads threadingly engaging and passing through one another so that the second seal member can slidingly move axially along the seal assembly;

a second energizing ring concentric with and located between the first and second seal members, the first seal member and second energizing ring being integrally formed of the same material and being moveable between a first and a second position, the second energizing ring and the second seal member having mating cylindrical surfaces that slide against one another while moving from the first to the second position, the second seal energizing ring moving from the first position to the second position in response to downward movement of the first seal member; and a delaying apparatus, the delaying apparatus preventing the first energizing ring from moving to the lower position until after the second energizing ring has moved to the second position.

2. The assembly according to claim 1, wherein the first energizing ring is operable to transfer a downward force on the energizing ring through the first seal member to the second energizing ring to cause the second energizing ring to move from the first position to the second position.

3. The assembly according to claim 1, wherein an upper thread of the first seal threads is operable to engage a lower thread of the second seal threads to withdraw the second seal in response to an upward movement of the seal member.

4. The assembly according to claim 1, wherein the lower sealing member has wickers.

5. The assembly according to claim 1, wherein the secondary seal is all metal.

6. The assembly according to claim 1, wherein the primary and secondary seals are all metal.

7. The assembly according to claim 1, wherein the delaying apparatus comprises a lower end on the first energizing ring having a first tapered surface at an angle oblique to an axis of the ring and extending laterally from the axis of the ring so that when the ring is inserted into the slot the tapered surface contacts an upper edge of one of the walls;

a second tapered surface adjacent the first tapered surface on a side opposite a lower terminal end of the ring, wherein an angle between the second tapered surface and the ring axis is less than the angle between the first tapered surface and axis; and wherein tapered upward facing shoulders formed on the inner and outer walls of the first seal member have an area that distributes a force applied to the first energizing ring so that sliding engagement of the energizing ring with the inner and outer walls is delayed until the second seal energizing ring moves to the second position.

8. A wellbore sealing assembly, the wellbore sealing assembly comprising:

a first wellbore member;

a second wellbore member concentrically located within the first wellbore member, the second wellbore member having an annular space to define an upward facing shoulder;

a seal assembly comprising:

a first seal member, the first seal member having inner and outer annular walls to define a slot therebetween;

a first energizing ring concentric with the first seal member and moveable between an upper and a lower position, the first energizing ring slidingly engaging the inner and outer walls to occupy the slot while moving from the upper to the lower position;

a second seal member concentric with and located below the first seal member;

a second energizing ring that is integrally formed of the same material as the first seal member and concentric with and located between the first and second seal members, moveable between a first and a second position, the second energizing ring and the second seal member having mating cylindrical surfaces that slide against one another while moving from the first to the second position, the second seal energizing ring being operable to move from the first position to the second position in response to a downward force from a running string acting on the first energizing ring, the downward force being transferred through the first seal member to the second energizing ring; and a delaying apparatus, the delaying apparatus preventing the first energizing ring from moving to the lower position until after the second energizing ring has moved to the second position.

9. The assembly according to claim 8, wherein the lower sealing member has wickers.

10. The assembly according to claim 8, wherein the primary and secondary seals are all metal.

11. The assembly according to claim 8, wherein the delaying apparatus comprises a lower end on the first energizing ring having a first tapered surface at an angle oblique to an axis of the ring and extending laterally from the axis of the ring so that when the ring is inserted into the slot the tapered surface contacts an upper edge of one of the walls;

a second tapered surface adjacent the first tapered surface on a side opposite a lower terminal end of the ring, wherein an angle between the second tapered surface and the ring axis is less than the angle between the first tapered surface and axis; and wherein tapered upward facing shoulders formed on the inner and outer walls of the first seal member have an area that distributes a force applied to the first energizing ring so that sliding engagement of the energizing ring with the inner and outer walls is delayed until the second seal energizing ring moves to the second position.

* * * * *